US005819320A

United States Patent [19]

Jolla

[11] Patent Number: 5,819,320

[45] Date of Patent: Oct. 13, 1998

[54] DETACHABLE TROUSER GARMENT

[76] Inventor: Roscoe Darnell Jolla, 1775 Ohio Ave., Long Beach, Calif. 90804

[21] Appl. No.: 939,273

[22] Filed: Sep. 29, 1997

[51] Int. Cl.[6] ..... A41D 1/00

[52] U.S. Cl. ..... 2/236; 2/227; 2/79

[58] Field of Search ..... 2/236, 227, 69, 2/79, 228, 238

[56] References Cited

U.S. PATENT DOCUMENTS

| | | | |
|---|---|---|---|
| D. 255,062 | 5/1980 | Hill et al. . | |
| 2,130,942 | 9/1938 | Blumberg | 2/236 |
| 3,949,427 | 4/1976 | Sampey . | |
| 4,158,892 | 6/1979 | Gonzales . | |
| 4,447,911 | 5/1984 | Marcellaro . | |
| 5,033,126 | 7/1991 | Wruck et al. . | |
| 5,425,719 | 6/1995 | Lessing, Jr. . | |

*Primary Examiner*—Gloria M. Hale
*Attorney, Agent, or Firm*—Goldstein & Canino

[57] ABSTRACT

The invention is a detachable trouser garment which allows police officers the ability to use restroom facilities without removing their firearm. The garment has a waist portion, a detachable portion and a horizontal fastening mechanism for selectively attaching both portions. The waist portion contains a plurality of belt loops to accept a standard belt and a firearm belt attachment to accept a firearm belt. A user opens the fastening mechanism prior to using restroom facilities. The detachable portion of the garment can then be lowered while the waist portion remains undisturbed. This allows the firearm to remain in proper position around the waist at all times.

4 Claims, 2 Drawing Sheets

DETACHABLE TROUSER GARMENT

BACKGROUND OF THE INVENTION

The present invention relates to a detachable trouser garment. More particularly, the invention relates to a trouser garment which separates at the waist to allow police officers the ability to use restroom facilities without removing their firearm.

From time to time, police officers and security personnel must remove themselves from their daily responsibilities to use restroom facilities. If wearing traditional trouser garments, the officer must first remove the firearm from their person in order to loosen and lower the garment when using the restroom.

Removing the firearm, even momentarily, poses a multitude of problems for the officers. It is important that the firearm remain on the waist so that the officer can quickly access it to protect him or herself. Another problem is that the risk of accidental discharge increases with repeated handling of the firearm. Still another problem is that the officer loses control of the firearm by removing it from the waist. This loss of control makes the firearm more susceptible to theft.

Various garments with non-traditional closure systems are known, but none of them address the problems presented. U.S. Pat. No. 4,447,911 relates to a jumpsuit which has hidden access panels to alleviate the user from removing the whole garment when using restroom facilities. This reference does not relate to trouser garments, the most preferred article of clothing for police officers, nor to the problems associated with carrying firearms as discussed.

While these units may be suitable for the particular purpose employed, or for general use, they would not be as suitable for the purposes of the present invention as disclosed hereafter.

SUMMARY OF THE INVENTION

It is an object of the invention to produce a trouser garment which detaches at a point below the waist, to allow the user to keep the waist portion in position when using restroom facilities.

It is another object of the invention to allow police officers to use restroom facilities without having to remove their firearm.

It is a further object of the invention that police officers, when using the invention, can maintain their firearms in accessible position at all times.

It is still another object of the invention to reduce the risk of accidental discharge of firearms.

It is yet another object of the invention to reduce the incidence of theft of police firearms.

It is still a further object of the invention to produce a trouser garment which is stylish and comfortable as well as functional.

The invention is a detachable trouser garment which allows police officers the ability to use restroom facilities without removing their firearm. The garment has a waist portion, a detachable portion and a horizontal fastening mechanism for selectively attaching both portions. The waist portion contains a plurality of belt loops to accept a standard belt and a firearm belt attachment to accept a firearm belt. A user opens the fastening mechanism prior to using restroom facilities. The detachable portion of the garment can then be lowered while the waist portion remains undisturbed, allowing the firearm to remain in proper position around the waist at all times. The invention promotes safety, decreases the risk of accidental discharge and deters theft by keeping the firearm within control of the officer. The fastening mechanism is concealed by a flap and not ordinarily noticeable to maintain a stylish look.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
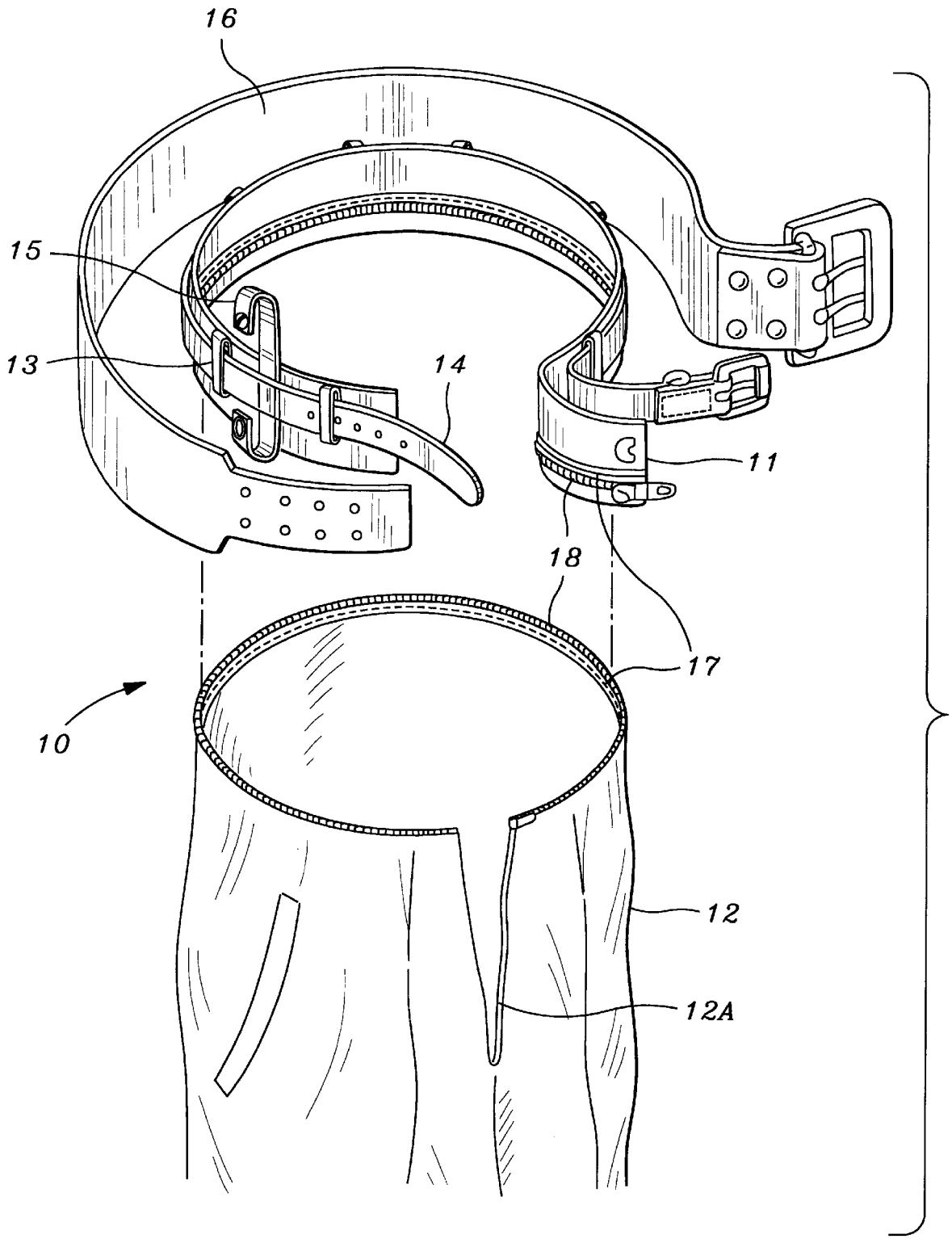
FIG. 1 is a front elevational view showing the present invention. Illustrated is a waist portion, a detachable portion, and a fastening mechanism to selectively attach both portions.

FIG. 1 illustrates a detachable trouser garment 10 having a waist portion 11 and a detachable portion 12. The garment 10 is designed to fit a user having a waist and legs. The waist portion 11 has a plurality of belt loops 13 to accept a standard belt 14. The waist portion 11 also has at least one firearm belt attachment 15 to keep a firearm belt 16 fixed to the waist of the user. The detachable portion 12 extends downward from the waist portion 11 and covers at least a portion of the legs of the user. The detachable portion 12 typically extends to the ankles, in the case of full length pants, although shorts are a contemplated use of the invention.

The waist portion 11 and the detachable portion 12 are selectively attached by a horizontal fastening mechanism. The preferred embodiment of the invention utilizes a zipper closure 17 as the fastening mechanism. However, buttons or hook and loop closures may be used as the fastening mechanism. FIG. 1 illustrates the zipper closure 17 with mating sets of teeth 18 on the waist portion 11 and the detachable portion 12 of the garment 10. The detachable portion 12 maintains a traditional vertical fastening mechanism 12A to facilitate removing the detachable portion 12 from the waist of the user.

Prior to using restroom facilities, a police officer opens the zipper closure 17 and the detachable portion 12 of the garment 10 is lowered. The waist portion 11 remains undisturbed and the firearm belt 16 remains in proper position around the waist at all times.

Figure 2:
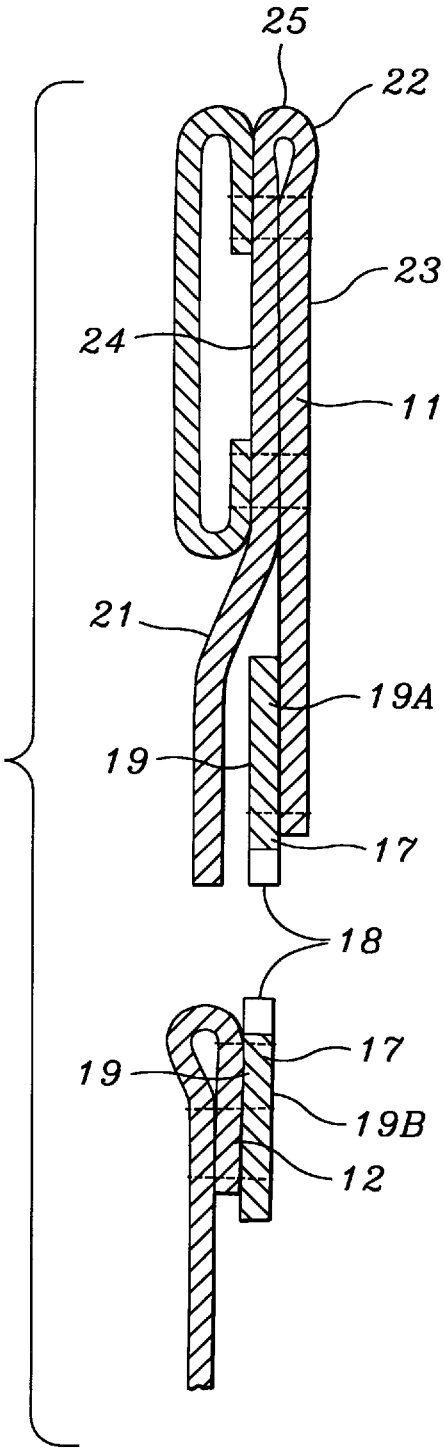
FIG. 2 is a side elevational cross-sectional view of the waist portion separated from the detachable portion according to the present invention.

FIG. 2 is a side elevational cross-sectional view of the waist portion 11, the zipper closure 17 and the detachable portion 12 of the present invention. As illustrated in FIG. 2, the zipper closure 17 has mating sets of teeth 18. The teeth 18 are located at the edges of zipper tape 19, the zipper tape having an upper end 19A and a lower end 19B. The upper end 19A of the zipper tape 19 is fixed to the waist portion 11 and the lower end 19B of the zipper tape 19 is fixed to the detachable portion 12 of the garment 10. The teeth 18 mate and attach the waist portion 11 and the detachable portion 12 of the trouser garment 10. A flap 21 extends from the waist portion 11 at point below the beltloops 13 to conceal the zipper closure 17. The flap 21 is typically made from the same material as the garment 10 so as to remain unnoticeable.

In the preferred embodiment of the invention, the waist portion 11 has a top 22, an interior wall 23, and an exterior wall 24. The interior wall 23, and the exterior wall 24 are made from one continuous piece of a material having a fold 25 at the top 22. The zipper closure 17 is fixed to the interior wall 23, and the flap 21 forms a lower most portion of the exterior wall 24. The flap 21 extends in front of and below the zipper closure 17 to completely conceal the zipper closure 17.

Figure 3:
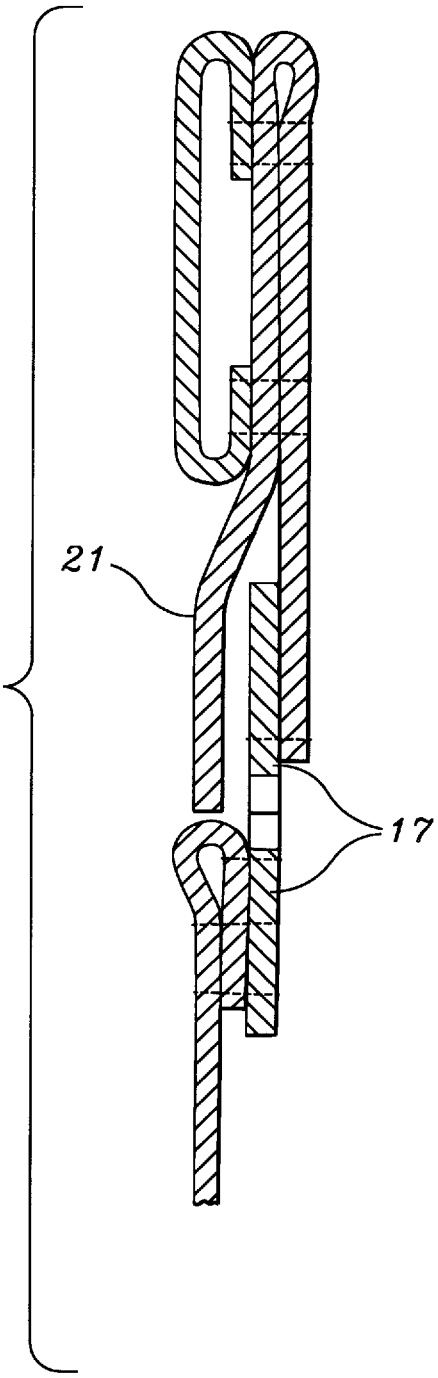
FIG. 3 is a side elevational cross-sectional view similar to FIG. 2, except with the waist portion fastened to the detachable portion according to the present invention.

FIG. 3 illustrates the trouser garment 10 FIG. 2, except with the zipper closure 17 in the mated position securing the waist portion 11 to the detachable portion 12. The flap 21 completely conceals the zipper closure 17 from view.

In conclusion, herein is presented a trouser garment, having a detachable portion which allows a police officer to use restroom facilities without the need to remove the firearm belt.

What is claimed is:

1. A detachable trouser garment for attaching to a user having a waist and legs comprising:

a waist portion which attaches and remains around the waist, comprising a plurality of beltloops for receiving a belt, a firearm belt attachment to hold a firearm belt, and a flap, made of the same material as the trouser garment to the make the flap unnoticeable, to conceal the horizontal fastening mechanism;

a detachable portion which extends downward from the waist portion and covers at least a portion of the legs; and a horizontal fastening mechanism to selectively attach the waist portion and the detachable portion.

2. The detachable trouser garment as recited in claim 1 wherein the zipper closure further comprises:

zipper tape, having an upper end and a lower end, the upper end of the zipper tape being fixed to the waist portion of the garment and the lower end of the zipper tape being fixed to the detachable portion of the garment; and teeth located at the edges of the upper end and the lower end of the zipper tape to attach the waist portion of the garment and the detachable portion of the garment.

3. The detachable garment as recited in claim 1 wherein the waist portion has a top, an exterior wall, and an interior wall, the exterior wall and the interior wall are made from one continuous piece of material having a fold at the top, the horizontal fastening mechanism is fixed to the interior wall, the flap forms a lower most portion of the exterior wall, and the flap extends in front of and below the horizontal fastening mechanism.

4. The detachable garment as recited in claim 3 wherein the horizontal fastening mechanism comprises a zipper closure.

* * * * *